United States Patent [19]

Eichner

[11] 4,412,621

[45] Nov. 1, 1983

[54] MAGAZINE ASSEMBLY FOR HOLDING INFORMATION BEARING CARDS AND THE LIKE

[75] Inventor: Falk-Jürgen Eichner, Coburg, Fed. Rep. of Germany

[73] Assignee: Eichner Organisation KG, Coburg, Fed. Rep. of Germany

[21] Appl. No.: 256,520

[22] Filed: Apr. 22, 1981

[30] Foreign Application Priority Data

Apr. 26, 1980 [DE] Fed. Rep. of Germany ..... 3016178

[51] Int. Cl.[3] ..... A47F 7/00

[52] U.S. Cl. ..... 211/58; 40/497; 211/165

[58] Field of Search ..... 211/58, 163, 165, 169, 211/68; 40/372, 497

[56] References Cited

U.S. PATENT DOCUMENTS

| | | | |
|---|---|---|---|
| 108,625 | 10/1870 | Phelps | 211/163 |
| 1,049,886 | 1/1913 | Manson | 211/165 |
| 1,342,517 | 6/1920 | Tyson | 211/68 X |
| 3,146,785 | 9/1964 | Iwashita | 135/25 R |
| 3,163,294 | 12/1964 | Barr | 211/58 |

FOREIGN PATENT DOCUMENTS

| | | | |
|---|---|---|---|
| 869253 | 5/1961 | United Kingdom | 211/163 |

*Primary Examiner*—James T. McCall
*Assistant Examiner*—David L. Talbott
*Attorney, Agent, or Firm*—Watson, Cole, Grindle & Watson

[57] ABSTRACT

A magazine assembly for holding information bearing cards and the like having support pins attached along one of the sides of the cards, includes a stand supporting a pair of spaced plates each having a plurality of openings inwardly spaced along the outer peripheries thereof for the pivotal reception of the opposite ends of the support pins, the openings in one of the plates extending into the outer peripheral edge thereof and being defined by a pair of edge walls extending between each of the openings and such peripheral edge, so that one of the ends of the pins may be guided into place within the openings in such one plate. And, a retaining disc mounted on the stand overlies such one plate and surrounds the outer periphery thereof for retaining such one ends of the pins in place.

2 Claims, 5 Drawing Figures

MAGAZINE ASSEMBLY FOR HOLDING INFORMATION BEARING CARDS AND THE LIKE

RELATED APPLICATION

This application relates to U.S. Ser. No. 256,654, filed Apr. 22, 1981, commonly owned herewith, entitled Rotary Magazine Assembly For Holding Information Bearing Cards and the Like.

BACKGROUND OF THE INVENTION

This invention relates generally to a magazine for holding information bearing cards and the like, and includes a stand having a pair of spaced apart discs or plates mounted thereon. Support pins attached along sides of the cards are pivotally received at opposite ends within openings located in the plates.

In magazines of this general type, the support pins for the information bearing cards are sometimes difficult to mount within the openings of the plates without the pins becoming subsequently dislodged. For example, after insertion of the support pins into the openings of one of the plates they must be either spring bent or otherwise maneuvered into place at their opposite ends within the openings of the other plate. Thus, the support pins oftentimes become unseated from the openings in the plates unless sufficient time and care is taken to insure that they are seated properly.

SUMMARY OF THE INVENTION

It is therefore an object of the present invention to provide a magazine for holding information bearing cards having support pins attached along one of the sides thereof, the pins being quickly and easily seated in place and being positively retained in place within the openings of the spaced apart plates.

In carrying out this general objective, the openings in an upper one of the plates extend into the outer peripheral edge of such plate and are defined by a pair of edge walls extending between each of the openings and the peripheral edge of the plate. Thus, after an end of each pin is received within the lower plate openings, the opposite ends of each pin may be guided into place within the openings in the upper plate. A disc is mounted over the upper plate and has a depending annular flange for closing the upper plate openings to thereby prevent any inadvertent removal. Each pair of such walls may diverge outwardly and have inner ends spaced apart a distance slightly smaller than the size of each of the openings from which they extend to thereby define snap openings into which the support pins may be effectively snapped into place. The disc overlying the upper plate could therefore be eliminated, although it is proposed that such a disc nevertheless be utilized to prevent inadvertent release of the support pins after they are snapped into place. The overlying disc may be in the form of a locking disc having a plurality of projections each inwardly extending betwen each of the pair of edge walls to positively insure against any unintentional removal of the support pins and to further insure rotary movement of the disc together with the spaced apart plates and the support pins attached to the information bearing cards.

Other objects, advantages and novel features of the invention will become more apparent from the following detailed description of the invention when taken in conjunction with the accompanying drawings.

DETAILED DESCRIPTION OF THE INVENTION

Figure 1:
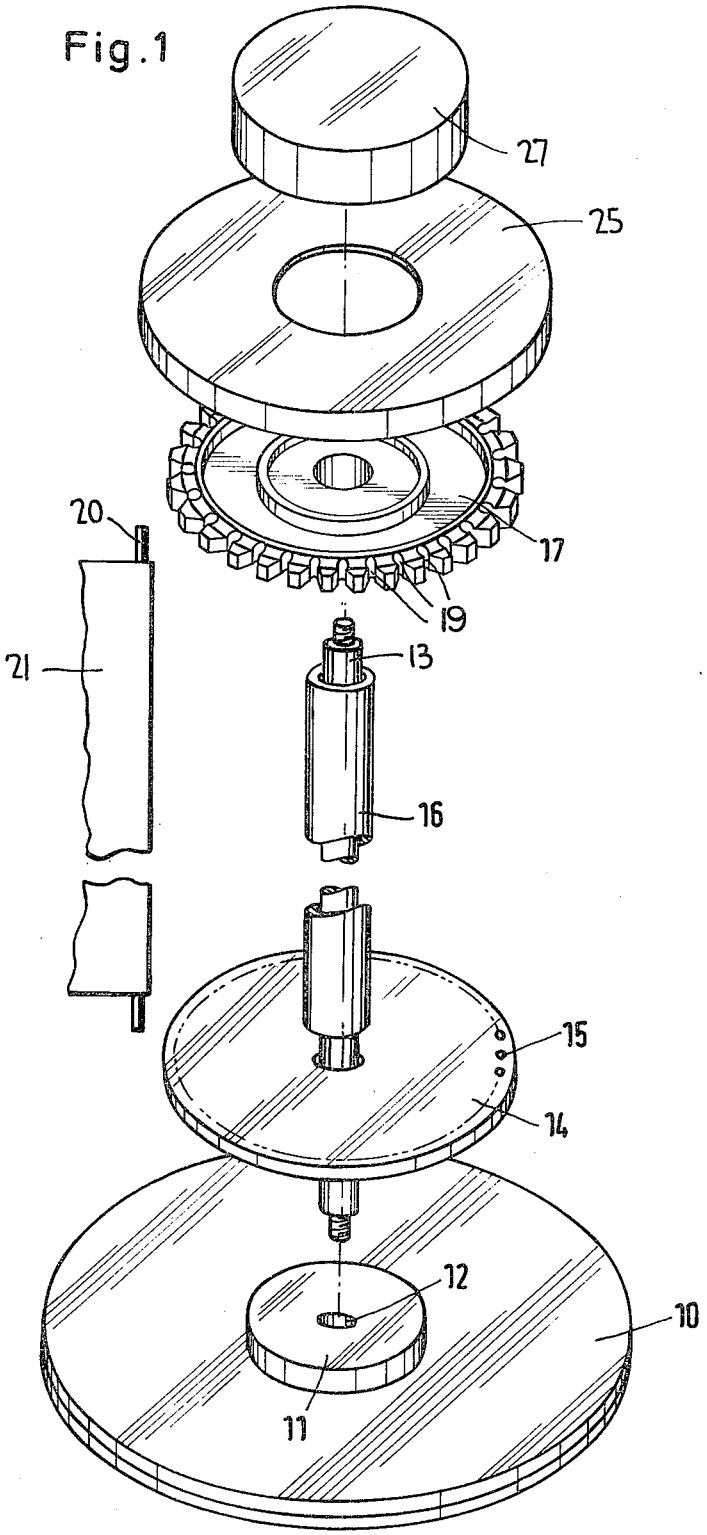
FIG. 1 is a perspective and expanded view of the magazine structure according to the invention.

Turning now to the drawings wherein like reference characters refer to like and corresponding parts throughout the several views, a magazine assembly of FIG. 1 includes the base plate 10 having a central boss 11 with an internally threaded central bore 12. An elongated axle 13 has an externally threaded lower end which threadedly engages bore 12 to therewith define a stand. The axle extends through a central opening in a lower plate or disc 14 which rests against boss 11. Plate 14 has a plurality of bores or openings 15 therein spaced along the outer peripheral edge of the plate. A casing 16 loosely surrounds axle 13 and rests against the upper surface of plate 14.

Figure 2:
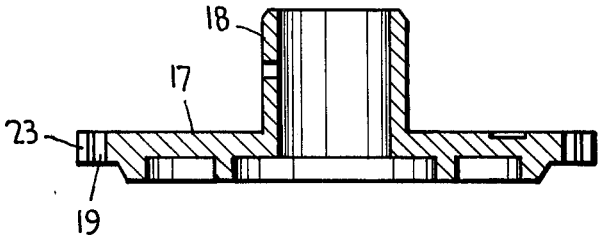
FIG. 2 is a vertical sectional view taken through the upper pin support plate of FIG. 1, shown inverted and slightly enlarged.
Figure 3:
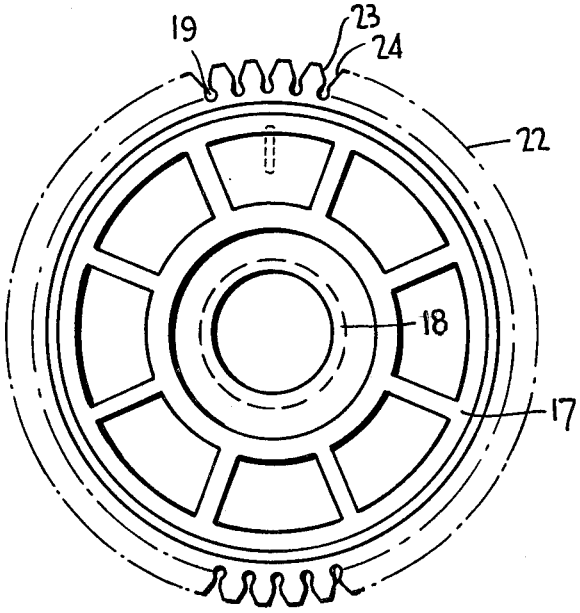
FIG. 3 is a bottom plan view of the FIG. 2 plate.
Figure 4:
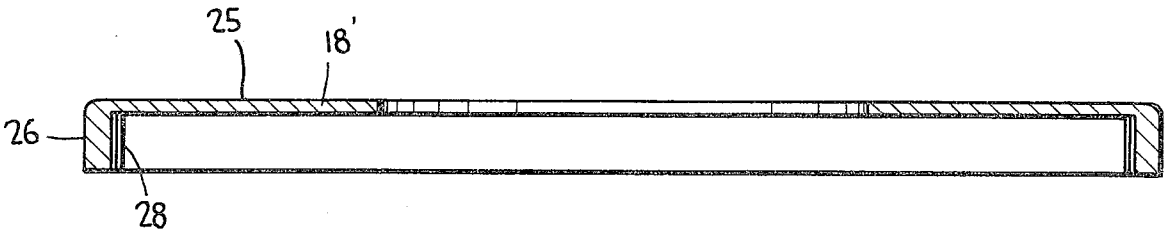
FIG. 4 is an enlarged vertical sectional view of the locking disc of FIG. 1 which overlies the upper pin support plate.
Figure 5:
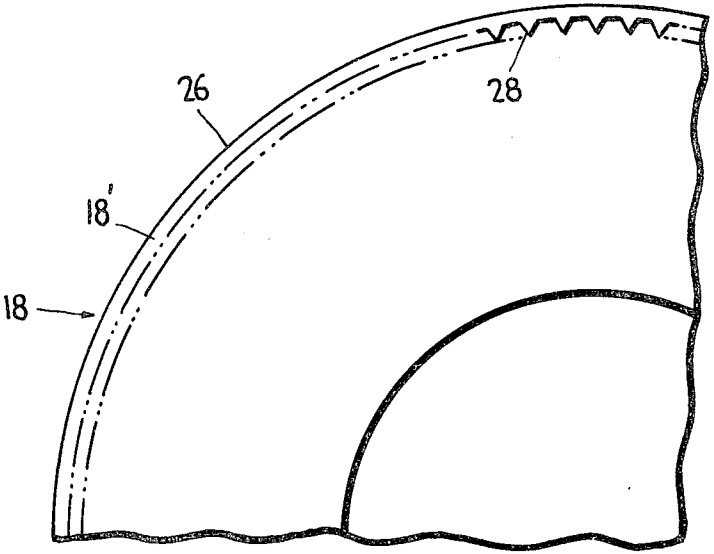
FIG. 5 is a partial bottom plan view of the FIG. 4 disc.

An upper disc or plate 17 having a depending central sleeve 18 (shown inverted in FIGS. 2 and 3) surrounds axle 13 and casing 16 and is secured to the latter by, for example, a set screw extending through the opening (unreferenced) shown in the wall of sleeve 18 in FIG. 2. Plate 17 likewise has a plurality of bores or openings 19 inwardly spaced along the outer peripheral edge thereof and respectively lying opposite openings 15 in the lower plate. And, this lower plate may likewise have a central sleeve (not shown) such as 18 which surrounds casing 16 and which is secured thereto similarly as plate 17. Both plates may have reinforcing ribs as shown.

Plates 14 and 17 as well as casing 16 may be rotatably mounted on axle 13 and said plates being spaced apart a sufficient distance to permit the opposite ends of support pins 20 to be pivotally received within opposed openings 15 and 19. These pins are attached along the sides of information bearing cards 21 which may otherwise be in the form of blank cards having receiving pockets thereon for items to be stored. Only one of such support pins and attached cards is shown in FIG. 1, although it should be understood that a plurality thereof are to be mounted in place.

In accordance with the invention, openings 19 in plate 17 have associated slots which extend and open into the outer peripheral edge 22 of the plate. Each of these slots is defined by a pair of edge walls 23, 24 which extend between each of the openings 19 and such peripheral edge, and which may diverge outwardly, as shown, with their inner ends spaced apart a distance slightly less than the size of each opening 19. Snap openings may therefore be formed to facilitate a snapping into place of the upper ends of the pins 20. Plate 17 should therefore be sufficiently elastic to permit the snap fit engagement of the support pins which may thus be easily and quickly mounted in place.

A disc 25 overlies plate 17 and has a depending peripheral flange 26 which surrounds openings 19 to prevent inadvertent removal of the pins. Disc 25 is held in place by a cap 27 having an internally threaded central bore (not shown) which threadedly engages the externally threaded upper end of axle 13.

Plate 17 and disc 25 may be of plastic material, and flange 26 of the disc may have a plurality of projections 28 each extending radially inwardly between the pairs of edge walls 23, 24 associated with openings 19. These projections 28 are similarly shaped to that of the spaces between edges 23, 24, and positively lock the ends of the support pins in place against any unintentional removal. Disc 25 may therefore be rotated together with plate 17, plate 14, casing 16, pins 20 and cards 21 about the central axis of axle 13.

Although axle 20 is shown lying parallel to the axis of axle 13 after being mounted in place between plates 14 and 17, it may be curved or slanted relative to such central axis, without departing from the scope of the invention. Retaining disc 25 will then be accordingly adapted for retaining pins 20 in place.

Obviously, many other modifications and variations of the invention are made possible in the light of the above teachings. It is therefore to be understood that within the scope of the appended claims, the invention may be practiced otherwise than as specifically described.

What is claimed is:

1. A rotary magazine assembly for holding information bearing cards and the like having support pins attached along one of the sides of the cards, comprising, a vertical axle having a support base, a pair of spaced plates rotatably mounted on said axle, a disc having a central aperture and overlying an upper one of said plates, said plates having a plurality of openings therein spaced along the outer peripheries thereof for the pivotal reception of opposite ends of said support pins, said openings in said plates respectively lying inwardly of said outer peripheries, said upper plates having slots each defined by a pair of diverging walls extending between each of said openings and said outer periphery thereof, each of said openings in said upper plate having a predetermined diametral size, and inner ends of each said pair of diverging walls being spaced apart a distance less than said size to thereby define snap openings for the reception of upper ends of said pins, said disc having a plurality of projections extending radially inwardly into said slots for positive locking said upper ends of said pins in place against unintentional removal.

2. The assembly according to claim 1, wherein said projections are shaped to match said slots.

* * * * *